US009254401B2

(12) United States Patent
Rogers et al.

(10) Patent No.: US 9,254,401 B2
(45) Date of Patent: Feb. 9, 2016

(54) JUMP ROPE ASSEMBLY

(71) Applicant: RPM Fitness, Inc., Los Gatos, CA (US)

(72) Inventors: Shane Patrick Rogers, San Jose, CA (US); Joshua Barry Rogers, Campbell, CA (US)

( * ) Notice: Subject to any disclaimer, the term of this patent is extended or adjusted under 35 U.S.C. 154(b) by 43 days.

(21) Appl. No.: 13/899,833

(22) Filed: May 22, 2013

(65) Prior Publication Data

US 2014/0121068 A1 May 1, 2014

Related U.S. Application Data

(60) Provisional application No. 61/719,409, filed on Oct. 28, 2012.

(51) Int. Cl.

| | |
|---|---|
| ***A63B 5/20*** | (2006.01) |
| ***A63B 5/22*** | (2006.01) |
| *A63B 21/055* | (2006.01) |

(52) U.S. Cl.

CPC . *A63B 5/20* (2013.01); *A63B 5/205* (2013.01); *A63B 21/0557* (2013.01)

(58) Field of Classification Search

CPC ..... A63B 5/20; A63B 5/205; A63B 21/0557; A63B 21/22

USPC ..... 482/81–82, 120, 126, 910; 403/60, 67, 403/78, 88, 235, 329; 16/428

See application file for complete search history.

(56) References Cited

U.S. PATENT DOCUMENTS

| | | | | | |
|---|---|---|---|---|---|
| 2,364,628 | A | * | 12/1944 | Garlinghouse | 403/40 |
| 2,942,881 | A | * | 6/1960 | Recalma | 482/82 |
| 3,650,123 | A | * | 3/1972 | Sheppard, Jr. | 464/133 |
| 4,179,119 | A | * | 12/1979 | Wolf | 482/82 |
| 4,561,797 | A | * | 12/1985 | Aldridge | 403/58 |
| 4,637,606 | A | * | 1/1987 | Hunn | 482/82 |
| 4,647,037 | A | * | 3/1987 | Donohue | 482/82 |
| 4,778,173 | A | * | 10/1988 | Joutras | 482/82 |
| 4,787,624 | A | * | 11/1988 | Grant | 482/82 |
| 4,869,492 | A | * | 9/1989 | Joutras | A63B 5/20 482/116 |
| 5,234,393 | A | * | 8/1993 | Heinrich | 482/81 |
| 5,478,297 | A | * | 12/1995 | Dennis, Jr. | 482/82 |
| 5,749,812 | A | * | 5/1998 | Feciura et al. | 482/82 |
| 6,551,222 | B1 | * | 4/2003 | Beaver | 482/82 |
| 6,752,746 | B1 | | 6/2004 | Winkler et al. | |
| 7,001,315 | B1 | * | 2/2006 | Diodati | 482/121 |
| 7,341,544 | B2 | | 3/2008 | St. George | |
| 7,462,140 | B1 | * | 12/2008 | Lombardozzi | 482/82 |

(Continued)

FOREIGN PATENT DOCUMENTS

| | | | | |
|---|---|---|---|---|
| CN | 102451555 | A | * | 5/2012 |
| DE | 2807651 | A1 | * | 2/1978 |

(Continued)

*Primary Examiner* — Oren Ginsberg
*Assistant Examiner* — Joshua Lee

(57) ABSTRACT

Disclosed is a jump rope comprising: an oil impregnated bushing; having a pair of handles with an external surface treatment. Additionally, the rope may include a fastener attached to each end and secured within the head of the jump rope yet still free to rotate about an axis formed by the centerline of the rope body. In some configurations a universal joint is attached to each end and secured to the jump rope handle, with one end of the input yoke acting as a column for rotation and one end of the output yoke used to secure the rope, and both free ends of each yoke attaching to the cross-trunnion to complete the assembly.

16 Claims, 9 Drawing Sheets

(56) References Cited

U.S. PATENT DOCUMENTS

| | | | | |
|---|---|---|---|---|
| 7,789,809 | B2 | 9/2010 | Borth et al. | |
| 7,976,438 | B1 * | 7/2011 | Hsu | A63B 5/20 482/81 |
| 8,043,196 | B1 | 10/2011 | Chen | |
| 8,062,193 | B2 * | 11/2011 | Oesterling | 482/82 |
| 8,136,208 | B2 * | 3/2012 | Borth et al. | 16/428 |
| D657,009 | S | 4/2012 | Krull | |
| 8,590,594 | B2 * | 11/2013 | Irvine | 164/100 |
| 8,806,733 | B2 * | 8/2014 | Szuba | 29/415 |
| 2003/0148859 | A1 * | 8/2003 | Chun | A63B 5/20 482/82 |
| 2004/0218383 | A1 * | 11/2004 | Bailey, III | A63B 5/20 362/169 |
| 2007/0093360 | A1 * | 4/2007 | Neff et al. | 482/8 |
| 2009/0247372 | A1 * | 10/2009 | Borth | A63B 5/20 482/82 |
| 2009/0247373 | A1 * | 10/2009 | Borth et al. | 482/82 |
| 2010/0160116 | A1 * | 6/2010 | LaTour | 482/8 |
| 2014/0080680 | A1 * | 3/2014 | Henniger et al. | 482/82 |

FOREIGN PATENT DOCUMENTS

| | | | | |
|---|---|---|---|---|
| GB | 2092013 A | * | 8/1982 | A63B 5/20 |
| GB | 2166058 A | * | 4/1986 | |

* cited by examiner

JUMP ROPE ASSEMBLY

CROSS-REFERENCE

This application claims the benefit of U.S. Provisional Application No. 61/719,409 filed Oct. 28, 2012, entitled Speed Jump Rope by Joshua Barry Rogers, which application is incorporated herein by reference.

BACKGROUND OF THE INVENTION

A traditional jump rope mainly comprises a rope and a pair of handles where the rope exits the end of the handle. While jumping rope the handles are held by the user and do not rotate in the user's hands but rather the rope rotates independent of the handles. Under this circumstance, the rotational friction and drag that are generated limit the maximum rotational speed of the rope. In speed competitions, is it desirable to have a jump rope with the highest rotational speed. Further, this requires a rope with the least amount of friction and air resistance to achieve the highest number of rotations in the least amount of time.

Jumping rope is an activity that is not only considered suitable for competition or recreation, but also provides a beneficial workout, similar to jogging or cycling. Jumping rope has been shown to achieve a "burn rate" of up to 700 calories per hour of vigorous activity, with about 0.1 calories consumed per jump. Ten minutes of jumping rope is roughly the equivalent of running an eight-minute mile.

Although jumping rope can be an excellent source of aerobic activity, depending on the choice of rope, some ropes exhibit failures such as handle separations, fraying of cables, and burrs after being cut to length making them not suited for the long term use that would occur with users relying on jumping rope for consistent aerobic activity. The exposed ends of the rope can also present a safety concern during use if not properly trimmed after sizing. Therefore, it is also desirable to have a rope whose ends are protected and captured within the head of the jump rope handles.

Another common problem with existing jump ropes is exhibited when the ropes ends are fixed at the rotational component or head of each handle and are not permitted to rotate freely within the head of the jump rope. Under this circumstance, undesirable torque can be built into the rope when the handles are inadvertently rotated perpendicular to the point where the rope accesses the handle unit. This torque in the rope presents a problem during use, as the ropes rotation is no longer uniform making it difficult to predict the rope placement while jumping rope. Therefore, it is desirable to have a rope whose ends are free to rotate about an axis formed by the centerline of the rope body. Existing jump ropes have attempted to address this problem by placing a collar or stop at each end of the rope. In these collar or stop type designs, the jump rope meets the intent of avoiding toque build up in the rope, but presents a new problem with the jump rope handles not remaining fixed to each end of the rope. The result is one or more handles displaced along the length of the rope with excess rope extended beyond the handle component, making the rope not equipped for jumping.

SUMMARY OF THE INVENTION

An object of the disclosure is to provide a jump rope utilizing a unique oil impregnated bushing design as to minimize rotational friction and drag during rope jumping without adding the significant cost and reliability issues associated with commercial ball bearings.

Another object of disclosure is to provide a jump rope whose rope's ends are captured yet the rope still freely rotates about an axis formed by the centerline of the rope body, preventing torque buildup in the rope.

Additionally, a jump rope with an oil impregnated bushing to prevent drag and friction and a braided cable to limit air resistance are being disclosed. The bushing can be, but is not limited to an Oilite® bushing. One embodiment of the rope is a 1/16" steel cable with a 1×19 braid pattern, another embodiment is a 1/16" steel cable with a 7×7 braid pattern. Additional embodiments of the rope include varying diameter, braid pattern, material, and the addition of a protective coating. The addition of a protective coating over the rope may extend the life of the rope by improving abrasion and kink resistance. Application of this coating may take multiple forms. Several embodiments include co-extruding, thermal bonding, helical wrapping, and overbraiding.

In at least some configurations, an individual's rope length is dependent on the users height and experience level. Therefore, it is desirable to have a rope that can be easily adjusted by the user to ensure a proper fit.

An aspect of the disclosure is directed to a jump rope assembly. The jump rope assembly, comprises: a rope body having a first end and a second end; and a first handle unit and a second handle unit wherein the first end of the rope body is secured within the first handle unit and the second end of the rope body is secured within the second handle unit, wherein the rope body freely rotates about an axis formed by a centerline of the handle which is perpendicular to a point where the rope accesses the handle unit, and further where the handle freely rotates about an axis formed by the centerline of the rope. In some configurations, the assembly can further comprise a handle assembly comprising a handle unit having an aperture, a bushing, a head, and a fastener wherein the fastener, fits within an aperture in the head, and a column from the head is secured within an aperture in the bushing and the bushing is secured within an aperture within the handle unit. Additionally, a screw can be provided which engages the fastener. The fastener can also be configured such that it accommodates rope bodies of differing configurations. Suitable bushings include, for example, an oil impregnated bushing. The rope body can be any suitable rope, such as, a braided steel cable. In at least some configurations, the exterior surface of the handle unit has an external surface treatment. External surface treatments can, for example, include treatment which improves a user's ability to grip the handle assembly. Additionally, the rope body can have a protective coating. Several embodiments of the protective coating include co-extruding, thermal bonding, helical wrapping, and overbraiding. To facilitate use by users of different heights and skill level, the rope body can also be adjustable in length. The handle unit can also be configured to comprise a universal joint where one end of the input yoke acts as a column for rotation and one end of the output yoke secures the rope, and both free ends of each yoke attach to a cross-trunnion.

Another aspect of the disclosure is directed to a method of using a jump rope assembly. The method comprises the steps of: engaging a jump rope assembly having a rope body having a first end and a second end via a first handle unit and a second handle unit wherein the first end of the rope body is secured within the first handle unit and the second end of the rope body is secured within the second handle unit, wherein the rope body freely rotates about an axis formed by a centerline of the handle which is perpendicular to a point where the rope accesses the handle unit, and further where the handle freely rotates about an axis formed by the centerline of the rope.

Still another aspect of the disclosure is directed to a kit. A suitable kit, such as a starter kit, comprises: an assembled jump rope having a rope body with a first end and a second end, and a first handle unit and a second handle unit wherein the first end of the rope body is secured within the first handle unit and the second end of the rope body is secured within the second handle unit, wherein the rope body freely rotates about an axis formed by a centerline of the handle which is perpendicular to a point where the rope accesses the handle unit, and further where the handle freely rotates about an axis formed by the centerline of the rope; and a packaging. Additionally, a suitable kit can include one or more of each of: a hex key; a screw; a rope; and a pouch or housing to contain the assembled jump rope and spare parts.

Yet another aspect of the disclosure is directed to a kit comprising one or more of at least two or more of the following: handle assemblies; two fasteners; four set screws; two heads; two bushings; two C-clips, two caps; and two U-joints, wherein the kit components are configurable to repair a jump rope assembly having a rope body with a first end and a second end, and a first handle unit and a second handle unit wherein the first end of the rope body is secured within the first handle unit and the second end of the rope body is secured within the second handle unit, wherein the rope body freely rotates about an axis formed by a centerline of the handle which is perpendicular to a point where the rope accesses the handle unit, and further where the handle freely rotates about an axis formed by the centerline of the rope.

INCORPORATION BY REFERENCE

All publications, patents, and patent applications mentioned in this specification are herein incorporated by reference to the same extent as if each individual publication, patent, or patent application was specifically and individually indicated to be incorporated by reference. See, for example, U.S. Des 657,009 S1 for Jump Rope Handle issued Apr. 3, 2013, by Mark Krull; U.S. Pat. No. 8,043,196 B1 for Jump Rope Assembly Having Enhanced Strength issued Oct. 25, 2011, by Chen; U.S. Pat. No. 7,341,544 B2 for Skipping Rope or Jump Rope Having Improved Asymmetric Handle issued Mar. 11, 2008 by David St. George; U.S. Pat. No. 6,752,746 B1 for Adjustable Jump Rope Apparatus with Adjustable Weight and Length issued Jun. 22, 2004 by Winkler, et al.; and U.S. Pat. No. 7,789,809 for Jump Rope System issued Sep. 7, 2010 by Paul E. Borth et al.

BRIEF DESCRIPTION OF THE DRAWINGS

The novel features of the invention are set forth with particularity in the appended claims. A better understanding of the features and advantages of the present invention will be obtained by reference to the following detailed description that sets forth illustrative embodiments, in which the principles of the invention are utilized, and the accompanying drawings of which:

DETAILED DESCRIPTION OF THE INVENTION

I. Devices

The jump rope of the present disclosure is configured as shown in the figures. The jump rope allows a user to achieve a high number of rotations per minute (RPM) during use by providing rotation about an axis corresponding to a centerline of the handle.

Figure 1:
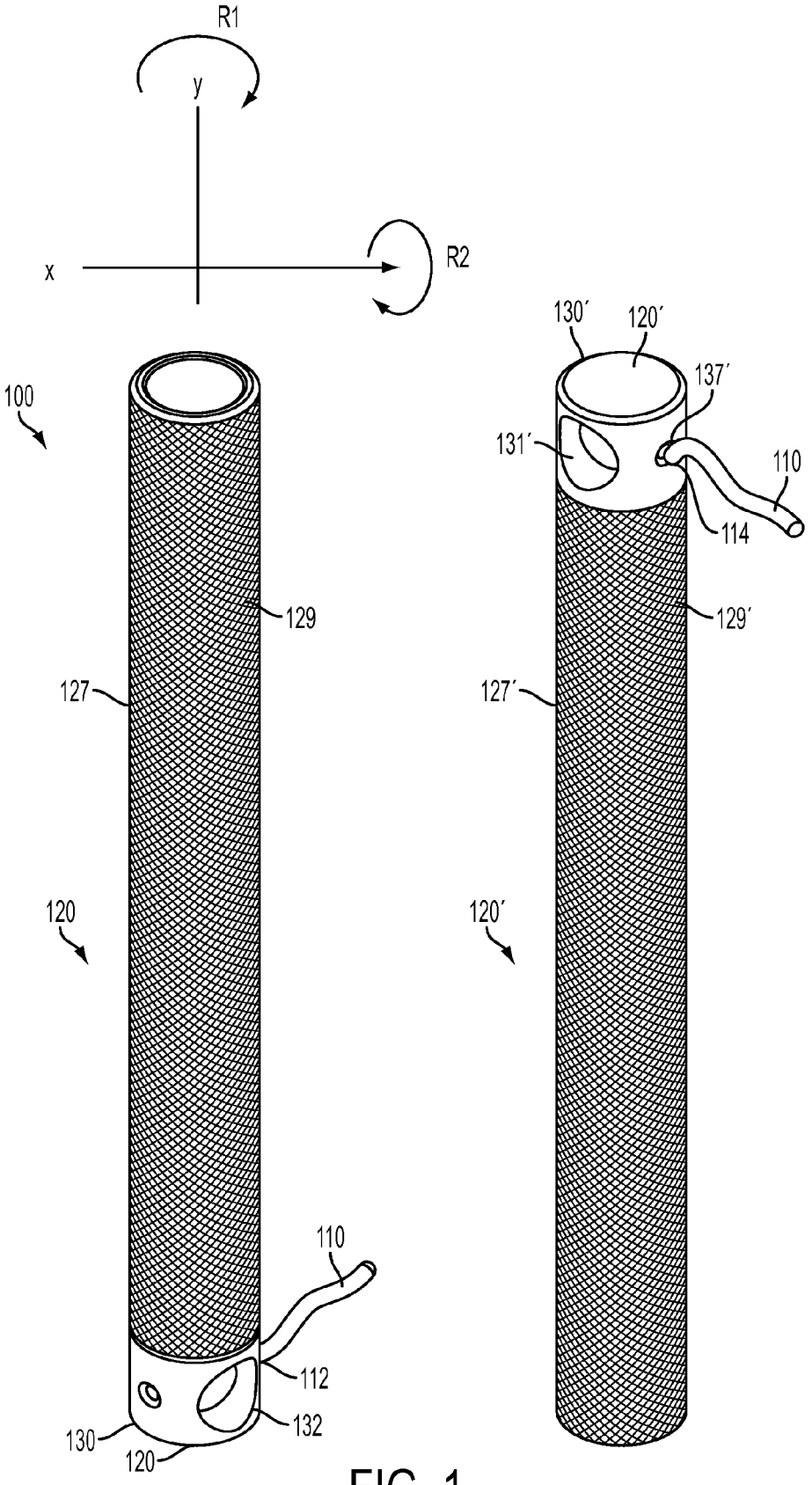
FIG. 1 is a perspective view of a jump rope according to the present disclosure, and views of the handle assembly.

As shown in FIG. 1, the jump rope 100 includes a rope 110 having a first end 112, and a second end 114. Each free end of the rope 110 is attached to a handle assembly 120, 120' resulting in two handle assemblies 120, 120' per jump rope 100. The handle interface 127, 127' of the handle assemblies 120, 120' can be configured such that it provides a grip, using a knurled surface 129, 129'. Other grip-friendly surfaces can also be used, such as a curved surface configured to engage fingers when the rope handle is being held and a rubberized surface with a high coefficient of friction configured to prevent the handle from slipping out of the users hands. In use, one end of the rope is secured to the handle assembly, but is secured in a way that allows rotation about at least two axes: rotation R1 about an axis that is parallel to the axis (x) formed by the handle; and rotation R2 about an axis that is perpendicular to the axis formed by the handle. The rope 110 extends from an aperture 137' in the head 130' of the handle assembly 120. Although only one aperture in the head of the handle assembly is depicted, as will be appreciated by those skilled in the art, each of the handle assemblies can be configured to provide the same mechanical features of attachment. Each head 120, 120' may include an additional aperture 132, 131', for example similar to apertures 332, 332' described below.

Figure 2A:
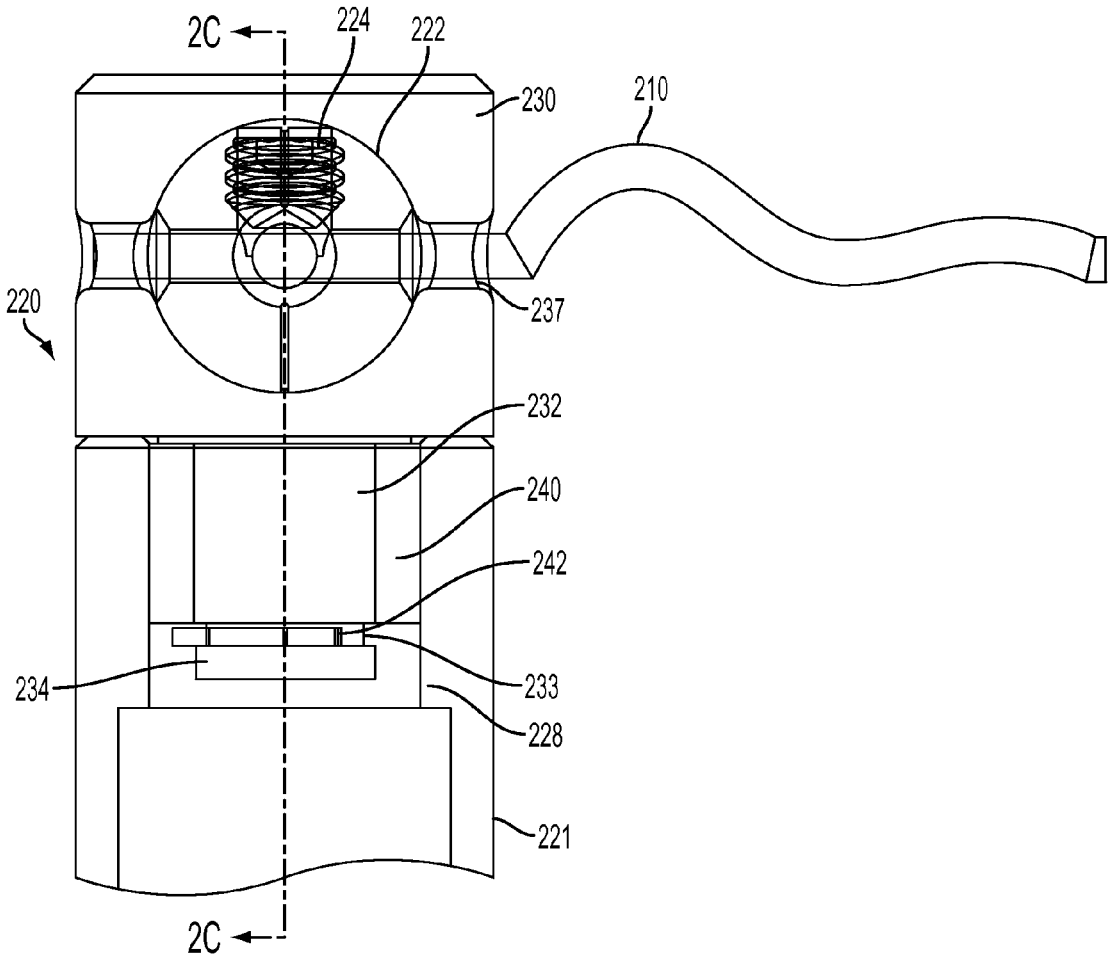
FIGS. 2A-C are an expanded and assembled view of jump rope in accordance with the present disclosure.
Figure 2B:
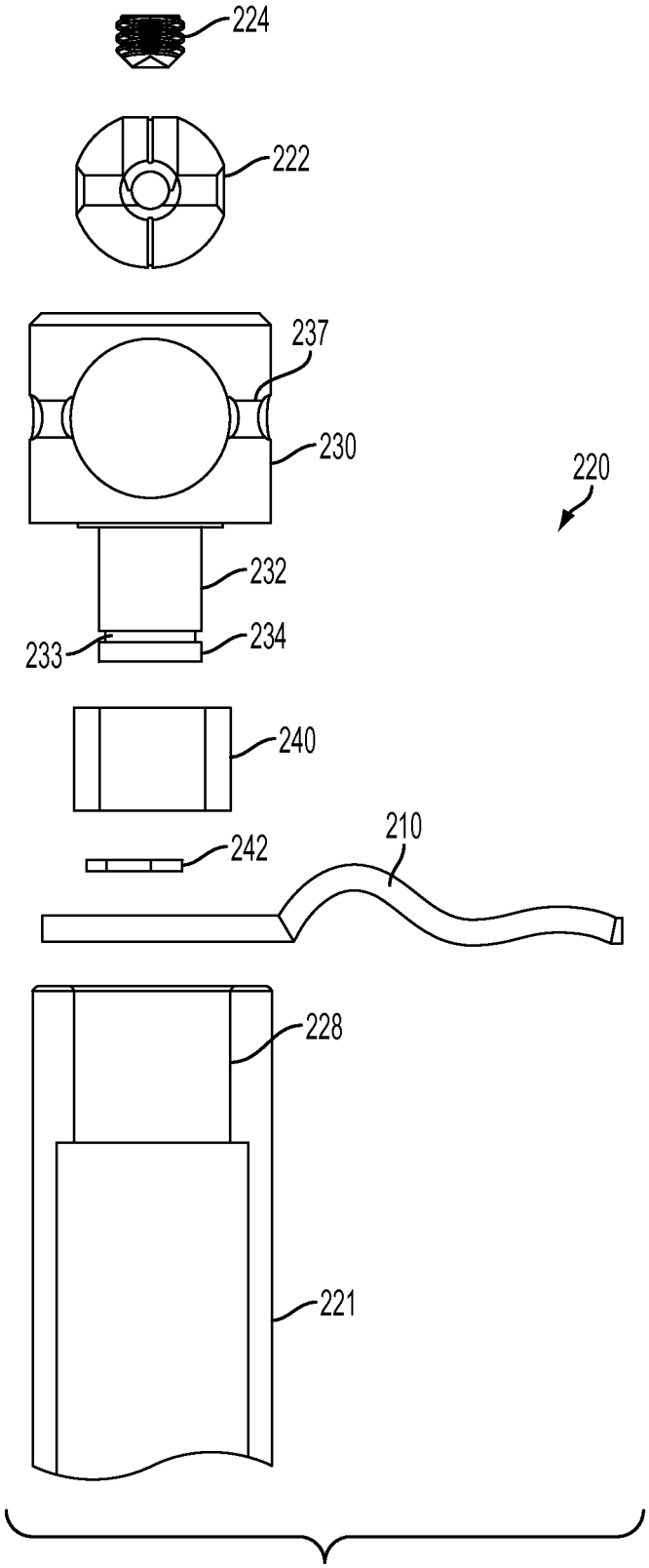
Figure 2C:
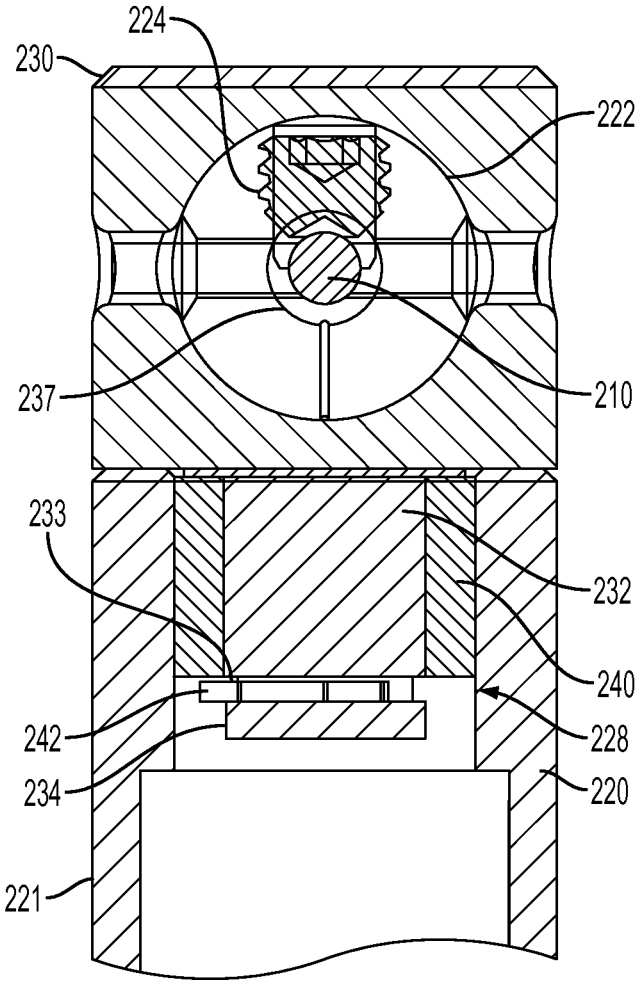

FIGS. 2A-C illustrate the head 230 of the handle assembly 220. As evidence from this view, the rope 210 is passed through an aperture 237, or through hole, in the head 230 and into the fastener 222. A set screw 224 is provided in a threaded channel. The set screw is moveable upon rotation of the screw such that the screw moves inwards towards the rope 210, or away from the rope, thus securing or releasing the rope 210 within the aperture. A column 232 extends from the head 230. The column 232 is sized to fit within a handle assembly aperture 228 and engages a bushing 240 about its exterior surface. The column 232 has a channel 233 with a projection 234 which is sized to engage a c-clip 242 within the channel 233.

FIG. 2B illustrates an expanded view of the handle assembly 220, while FIG. 2A and FIG. 2C (which is a view taken along the cross-section of 2C-2C in FIG. 2A) illustrate an assembled view and a cross-section thereof. The expanded view more clearly shows the set screw 224, the fastener 222, which fits within the head 230. The head 230 has an aperture 237 which is sized to fit the rope 210. A column 232 extends from one surface of the head 230. The column has a channel 233, which has a projection 234 defining one side of the channel. A bushing 240 fits around the column and is secured in place by a c-clip 242 which is sized to fit within the channel 233. The column and bushing fit within a handle assembly aperture 228 of the handle 221.

As shown in FIG. 2C, the rope 210 is secured in a fastener 222 via a suitable securement device, such as a set screw 224. One embodiment of the rope 210 is a 1/16" steel cable with a 1×19 braid pattern, another embodiment is a 1/16" steel cable with a 7×7 braid pattern. As will be appreciated by those skilled in the art, other configurations can be used to achieve the performance of this configuration without departing from the scope of the disclosure.

Figure 4:
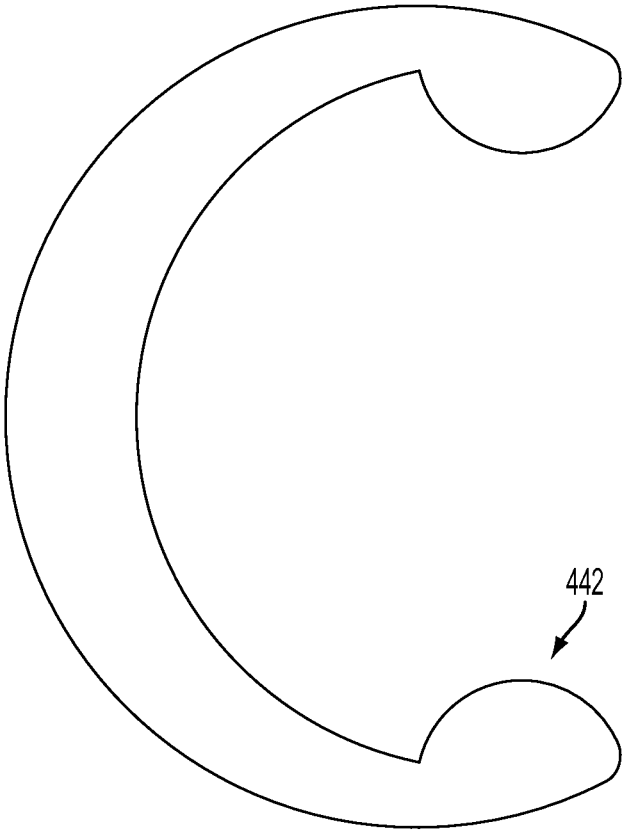
FIG. 4 is a view of an external retaining ring.

Each head 230 includes a column 232 having a channel 233 which extends beyond a bushing 240 which is secured via a c-clip 242 (see also, FIG. 4). This subassembly is then pressed into the handle unit aperture 228 of the handle 221, and is fixed in place via an interference fit between the inner diameter of the handle unit aperture 228 and an outer diameter of the bushing 240. The bushing 240 can be an oil impregnated bushing. The bushing 240 can be, but is not limited to an Oilite® bushing. Additionally, a bearing may be used in place of a bushing if desired.

Turning now to FIGS. 3A-D the head 330, 330', 330", 330'" is shown with an aperture 332, 332', 332", 332'" to accept a fastener similar in function to that of 222 shown in FIG. 2, a pair of apertures 337, 337' to accept the rope (210 shown in FIGS. 2). The embodiment shown in FIG. 3C includes two pair of apertures 337, 337' and 338, 338' positioned perpendicular to one another providing the user with flexibility in the orientation to which the rope (210 shown in FIG. 2) exits the head 330". Head 330, 330', 330", 330'" include a projection 334 at the back end 331' which engages the bushing (240 shown in FIG. 2). The projection 334 can have a recessed section forming a groove 336 at the back end 331'.

In one embodiment, the front end 331 of the head 330' can be threaded or have a lip to engage a cap, not illustrated.

Turning to FIG. 4 an external retaining clip 442 is shown. The retaining clip 442 engages the head and the bushing (230, 240, respectively, both shown in FIG. 2).

Figure 5A:
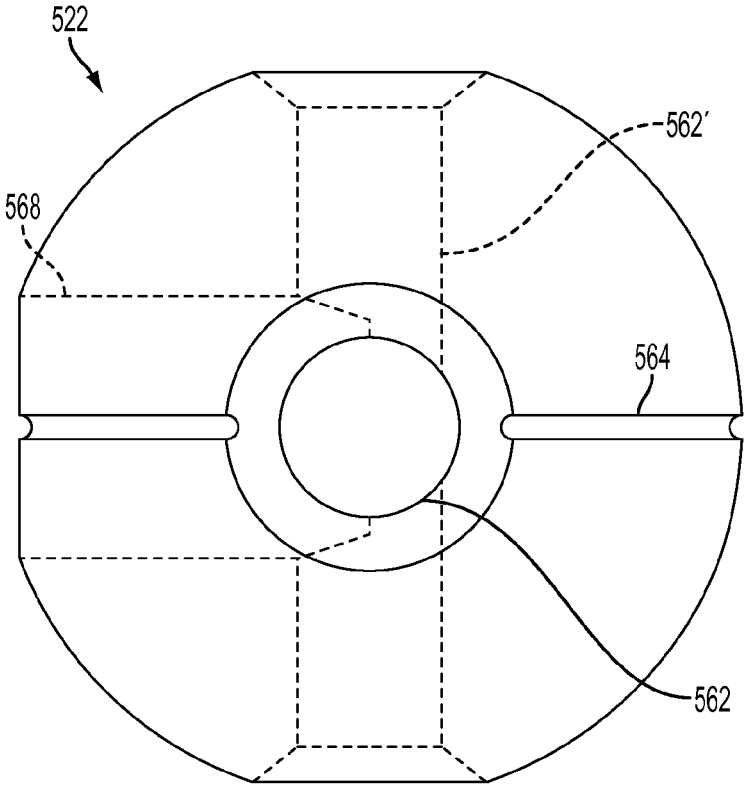
FIGS. 5A-B are views of varying configuration of the fastener.

FIG. 5 A illustrates a fastener 522 designed to be compatible with the head (330, 330', 330" shown in FIG. 3A-C) having one or more central apertures 562, 562' and an alignment channel 564. Apertures 562, 562' are configured to be of the same size or slightly larger in diameter than the rope 210 shown in FIG. 2 to which they will be receiving. Sizing of apertures 562, 562' at a diameter approximately the same size as the outside diameter of the rope (210 shown in FIG. 2) ensures proper engagement with the rope and set screw (210, 224, respectively, both shown in FIG. 2). Having two sets of apertures 562, 562' facilitate the independent use of two different diameter ropes (210 shown in FIG. 2) while maintaining a consistent and optimal clearance between the rope (210 shown in FIG. 2) and fastener 522 apertures 562, 562'. Fastener 522 may include one or more threaded holes 568 to accept a set screw (224 shown in FIG. 2).

Figure 3A:
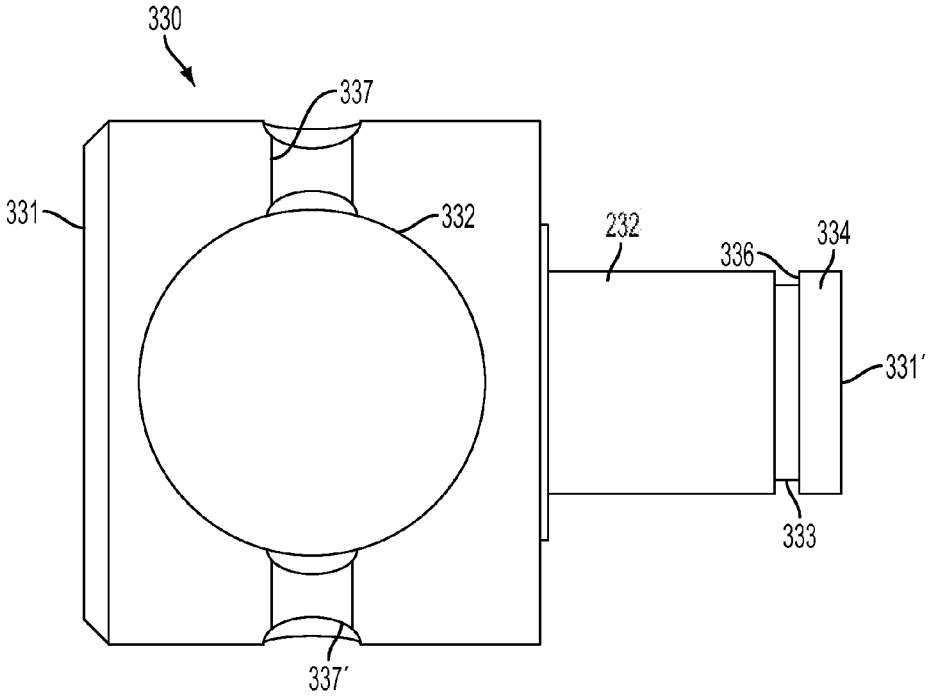
FIGS. 3A-D are views of varying configurations of the head.
Figure 3B:
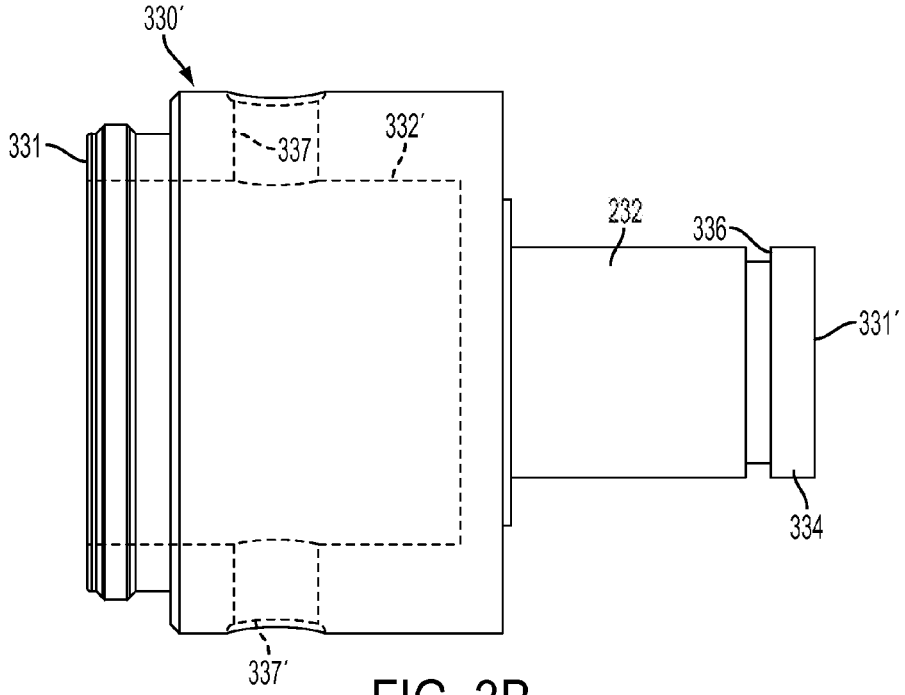
Figure 3C:
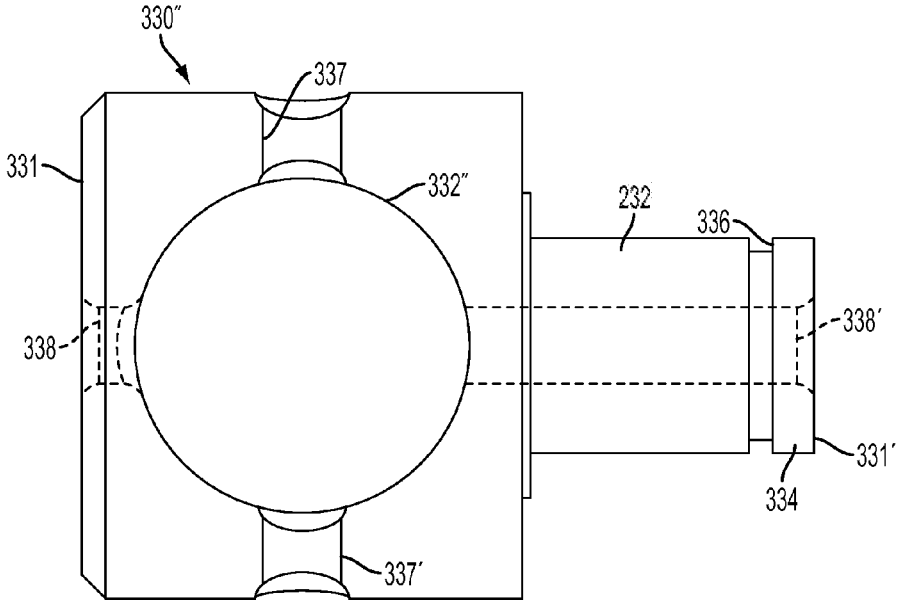
Figure 3D:
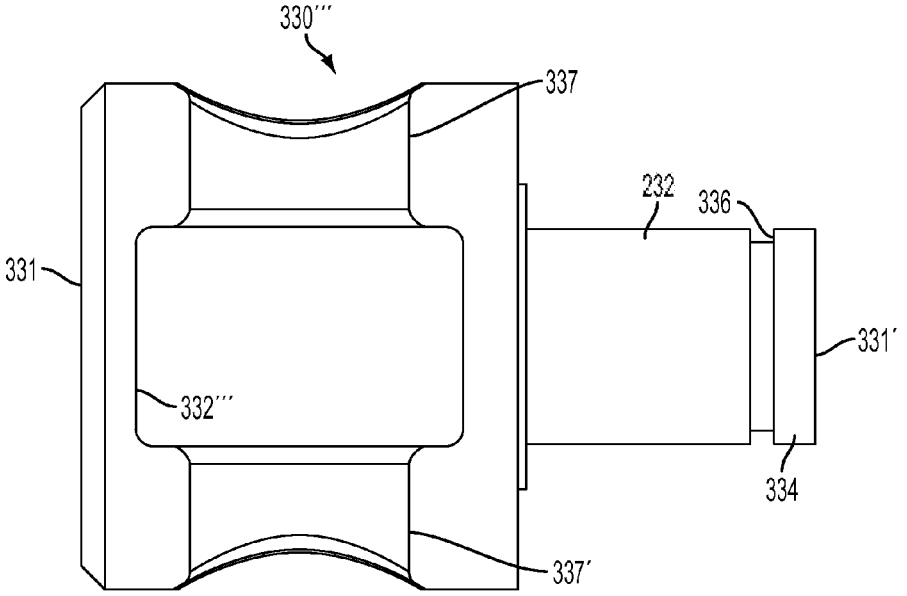
Figure 5B:
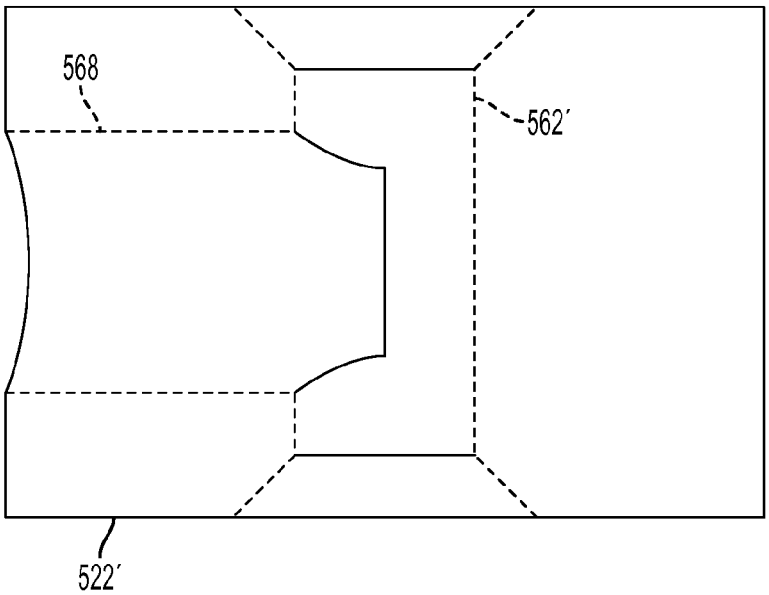

FIG. 5B illustrates another embodiment of a fastener 522' designed to be compatible with the head 330'" shown in FIG. 3D. In this embodiment the fastener 522' is fixed parallel to the axis (y) and the result fixes the rope 110 to the axis (x) shown in FIG. 1.

A handle assembly, such as 220 shown in FIG. 2, that is capable of accommodating different styles (e.g. diameter, material, density, braid pattern, etc) of ropes is desirable to provide the user the flexibility to select the appropriate rope for a given application. Additionally, the fastener, such as 222 shown in FIG. 2, can be configured to provide multiple apertures to accommodate ropes of various diameters. Thus, for example, for the handle assembly 220 in FIG. 2, the multiple apertures provided in the fastener 222 can be configured such that the apertures approximate the diameter of the rope. In the event that that these apertures are not closely matched with the apertures in the fastener, being the same size or slightly larger than the diameter of the rope, the rope may be forced to become out of round by the set screw 224. Under this circumstance the rope 210 may get pulled out of the fastener 222 and handle assembly 220 when put under tension.

Figure 6:
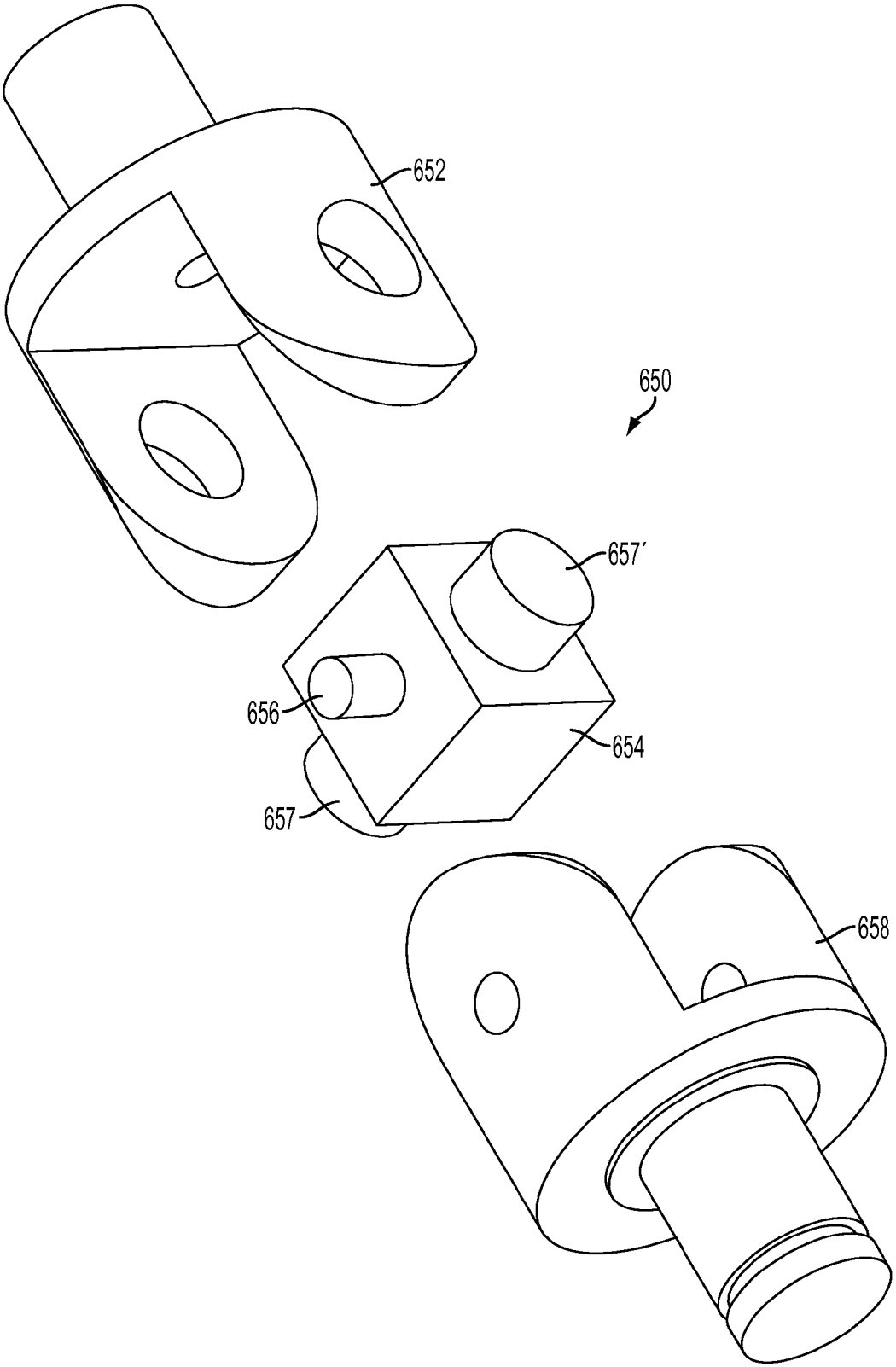
FIG. 6 illustrates of an alternative universal joint configuration for use with the jump rope of the present disclosure.

Another embodiment of the present invention includes a universal joint (u joint) 650 as depicted in FIG. 6. In this configuration the universal joint 650 replaces the head 230 and fastener 222 both shown in FIG. 2. The universal joint 650 includes an input yoke 658, a cross-trunnion 654, and an output yoke 652. One end of the input yoke 658 has geometry similar to the column 232 of the head 230 both described in FIG. 2. The cross-trunnion 654 has a first pair of coaxial projections 656, 656' and a second pair of coaxial projections 657, 657' which provide support about which turning movement occurs. Although only one projection is depicted, as will be appreciated by those skilled in the art, each of the projections can be configured to provide the same support about which turning movement occurs.

The opposing end of the input yoke 658 has geometry capable of receiving the cross-trunnion 654. The output yoke 652 includes geometry on one end similar to the fastener 222 described in FIG. 2 in that it has the ability to secure the rope 210 described in FIG. 2. The other end of the output yoke 652 has geometry capable of receiving a pair of second coaxial projections 657, 657' of the cross-trunnion 654. Under this embodiment the rope is free to position itself in its most natural and relaxed orientation while jumping rope. Additionally, similar to what was described above, the universal joint assembly 650 reduces the possibility of building up torque in the rope in the event that the rope is inadvertently rotated perpendicular to the point where the rope accesses the handle unit.

II. Methods of Use

Using a device as disclosed above, a user engages in the activity of jumping rope. In using the device, a user can achieve a "burn rate" of up to 700 calories per hour of vigorous activity, with about 0.1 calories consumed per jump. The rope can have an oil impregnated bushing to prevent drag and friction and a braided cable to limit air resistance. As described above, the bushing can be, but is not limited to an Oilite® bushing. One embodiment of the rope is a 1/16" steel cable with a 1×19 braid pattern another embodiment is a 1/16" steel cable with a 7×7 braid pattern. Additional rope configurations can be used without departing from the scope of the disclosure.

The rope turns about an axis (y) through the centerline of the handle.

III. Kits

Devices and components thereof can be provided in kit form wherein the kit components are packaged in suitable packaging material. Kits can include, for example, one of more of each of the following: an assembled jump rope; a hex key, a screw, a rope, a pouch or housing to contain the assembled jump rope and spare parts. Other kits can include a plurality of ropes, two handle assemblies, two fasteners, four set screws, two heads, two bushings, two C-clips, two caps, and two U-joints.

While preferred embodiments of the present invention have been shown and described herein, it will be obvious to those skilled in the art that such embodiments are provided by way of example only. Numerous variations, changes, and substitutions will now occur to those skilled in the art without departing from the invention. It should be understood that various alternatives to the embodiments of the invention described herein may be employed in practicing the invention. It is intended that the following claims define the scope of the invention and that methods and structures within the scope of these claims and their equivalents be covered thereby.

What is claimed is:

1. A jump rope assembly, comprising:

a rope body having a first end and a second end;

a first handle unit and a second handle unit, each of said first and second handle units comprising a head that freely rotates about a handle axis formed by a centerline of the handle unit, wherein the first end of the rope body is secured within a first fastener rotatably disposed within the head of the first handle unit and the second end of the rope body is secured within a second fastener rotatably disposed within the head of the second handle unit, wherein each fastener freely rotates within each head about a rope axis that is substantially perpendicular to the handle axis and formed by a centerline of the rope body.

2. The jump rope assembly of claim 1, wherein the first and second handle units each further comprises an aperture and a bushing, wherein the fastener fits within an aperture in the head, and a column from the head is secured within an aperture in the bushing and the bushing is secured within the aperture within the handle unit.

3. The jump rope assembly of claim 2, further comprising a screw which engages the fastener.

4. The jump rope assembly of claim 2, wherein the fastener is provided to accommodate rope bodies of differing configurations.

5. The jump rope assembly of claim 2, wherein the bushing is an oil impregnated bushing.

6. The jump rope assembly of claim 1, wherein the rope body is a braided steel cable.

7. The jump rope assembly of claim 1, wherein an exterior surface of the handle unit has an external surface treatment.

8. The jump rope assembly of claim 1, wherein the rope body has a protective coating.

9. The jump rope assembly of claim 8, wherein the protective coating is helically wrapped.

10. The jump rope assembly of claim 8, wherein the protective coating is overbraided.

11. The jump rope assembly of claim 1, wherein the rope body is adjustable in length.

12. The jump rope assembly of claim 1, further where the head comprises a universal joint having an input yoke, an output yoke, and a cross-trunnion, where one end of the input yoke acts as a projection for rotation and one end of the output yoke secures the rope body, and both free ends of each yoke attach to the cross-trunnion.

13. A method of using a jump rope assembly, comprising the steps of: engaging a jump rope assembly having a rope body having a first end and a second end via a first handle unit and a second handle unit wherein the first end of the rope body is secured within a first fastener rotatably disposed within a head of the first handle unit and the second end of the rope body is secured within a second fastener rotatably disposed within a head of the second handle unit, wherein each fastener freely rotates within each head of each handle unit about an axis formed by a centerline of the rope body, which is perpendicular to a handle axis formed by a centerline of the handle unit, and further where the head of each handle unit freely rotates about the respective handle axis.

14. A kit comprising:

an assembled jump rope having a rope body with a first end and a second end, and a first handle unit and a second handle unit wherein the first end of the rope body is secured within a first fastener rotatably disposed within a head of the first handle unit and the second end of the rope body is secured within a second fastener rotatably disposed within a head of the second handle unit, wherein each fastener freely rotates within each head of each handle unit about an axis formed by a centerline of the rope body, which is perpendicular to a handle axis formed by a centerline of the handle unit, and further where the head of each handle unit freely rotates about the respective handle; and a packaging.

15. The kit of claim 14 further comprising one or more of each of:

a hex key;

a screw;

a rope; and a pouch or housing to contain the assembled jump rope and spare parts.

16. A kit comprising one or more of at least two or more of the following:

handle assemblies;

fasteners;

set screws;

heads;

bushings;

C-clips, caps;

and U-joints, wherein the kit components are configurable to repair a jump rope assembly having a rope body with a first end and a second end, and a first handle unit and a second handle unit wherein the first end of the rope body is secured within a first fastener rotatably disposed within a head of the first handle unit and the second end of the rope body is secured within a second fastener rotatably disposed within a head of the second handle unit, wherein each fastener freely rotates within the head of each handle unit about an axis formed by a centerline of the rope body, which is perpendicular to a handle axis formed by a centerline of the handle unit, and further where the head of each handle unit freely rotates about the respective handle axis.

* * * * *